US009851138B2

(12) United States Patent
Laible

(10) Patent No.: US 9,851,138 B2
(45) Date of Patent: Dec. 26, 2017

(54) TELESCOPIC PULL-OUT SHELF FOR A REFRIGERATION DEVICE

(75) Inventor: Karl-Friedrich Laible, Langenau (DE)

(73) Assignee: BSH Hausgeräte GmbH, Munich (DE)

( * ) Notice: Subject to any disclaimer, the term of this patent is extended or adjusted under 35 U.S.C. 154(b) by 2580 days.

(21) Appl. No.: 11/918,822

(22) PCT Filed: Mar. 28, 2006

(86) PCT No.: PCT/EP2006/061104

§ 371 (c)(1),
(2), (4) Date: Oct. 17, 2007

(87) PCT Pub. No.: WO2006/120065

PCT Pub. Date: Nov. 16, 2006

(65) Prior Publication Data

US 2009/0066207 A1 Mar. 12, 2009

(30) Foreign Application Priority Data

May 10, 2005 (DE) ..... 10 2005 021 589

(51) Int. Cl.

| | |
|---|---|
| ***A47B 96/04*** | (2006.01) |
| ***A47B 88/00*** | (2017.01) |
| ***F25D 25/02*** | (2006.01) |
| ***A47B 88/427*** | (2017.01) |

(52) U.S. Cl.
CPC ..... *F25D 25/025* (2013.01); *A47B 88/427* (2017.01)

(58) Field of Classification Search
CPC ..... F25D 25/025; A47B 88/427
USPC ..... 312/404, 330.1, 334.1–334.22; 24/297, 24/453, 457, 458
See application file for complete search history.

(56) References Cited

U.S. PATENT DOCUMENTS

| | | | | |
|---|---|---|---|---|
| 2,649,351 | A | 8/1953 | Rothchild | |
| 3,651,545 | A * | 3/1972 | Hara | 24/305 |
| 3,712,690 | A * | 1/1973 | Fall | 384/18 |
| 3,889,320 | A * | 6/1975 | Koscik | 24/297 |
| 4,370,007 | A | 1/1983 | Fler | |
| 5,015,047 | A | 5/1991 | Nock | |
| 5,669,731 | A * | 9/1997 | Hironaka et al. | 403/397 |
| 7,270,384 | B2 * | 9/2007 | Koloff et al. | 312/404 |
| 2003/0173882 | A1 | 9/2003 | Koons | |
| 2006/0152119 | A1 * | 7/2006 | Park | 312/404 |
| 2006/0242802 | A1 * | 11/2006 | Scroggie | 24/297 |
| 2008/0203875 | A1 * | 8/2008 | Lim et al. | 312/404 |
| 2009/0121599 | A1 * | 5/2009 | Laible | 312/404 |
| 2010/0019637 | A1 * | 1/2010 | Guttinger | 312/334.5 |
| 2010/0019641 | A1 * | 1/2010 | Laible et al. | 312/404 |

* cited by examiner

*Primary Examiner* — Daniel J Troy
*Assistant Examiner* — Timothy M Ayres
(74) *Attorney, Agent, or Firm* — Nixon & Vanderhye, P.C.

(57) ABSTRACT

The invention relates to a telescopic pull-out shelf with at least two runners which are movably guided one on the other so that they can be displaced relative each other in the longitudinal direction. A support on the first runner is resiliently fastened in the direction of movement of the runners.

28 Claims, 6 Drawing Sheets

TELESCOPIC PULL-OUT SHELF FOR A REFRIGERATION DEVICE

This application is a U.S. National Phase of International Patent Application No. PCT/EP2006/061104, filed Mar. 28, 2006, which designates the U.S. and claims priority to German Patent Application No. DE 10 2005 021 589.0, filed May 10, 2005, the entire contents of each of which are hereby incorporated by reference.

The present invention relates to a telescopic pull-out shelf comprising at least two runners which are movably guided one on the other so that they can be displaced relative to each other in the longitudinal direction and a support, for example in the form of a support plate or a drawer compartment, fastened to a first of the runners.

The runners of such a telescopic pull-out shelf are intended to run smoothly, so that the support, even when it is heavily loaded, may be withdrawn with little force expenditure from a housing in which the pull-out shelf is installed. Generally, pull-out shelves of this type comprise stops which limit the freedom of movement of the runners relative to one another, so that the runners are not completely pulled apart from one another inadvertently. Such a stop is conventionally formed by a rubber buffer which is accommodated in an intermediate space between two runners movably guided one on the other and is fixedly connected to one of the runners, and a projection connected to the other runner, which, when the end of the permissible freedom of movement has been reached, strikes the rubber buffer and thus brakes the support.

As the support of such a telescopic pull-out shelf is frequently heavily loaded during use, with the impact of the pin on the buffer, considerable forces occur which heavily load a connection between the support and the runner of the pull-out shelf, which may be moved together with said support, and with careless use may lead to damage of the support and/or the connection.

It is the object of the invention to specify a telescopic pull-out shelf in which the inertial forces acting between the support and the runner when the support is braked are reduced and, as a result, the risk of damaging the support and runner is reduced.

The object is achieved according to the invention, by the support being resiliently fastened to the first runner in the direction of movement of the runners. Thus instead of providing the runners with springs relative to one another, in the conventional manner, in order to reduce the deceleration occurring when the stop is reached, a resilience is provided according to the invention between the support and the runner. Said resilience may replace or even complement conventional resilience between the runners.

Preferably, the resilience is produced by the first runner carrying a latching projection with at least one edge which is resiliently flexible in the direction of movement of the runners. This edge may, when the runner reaches its stop, be resiliently deformed by the inertial force of the support and the objects carried thereby, in order to reduce the deceleration occurring when the stop is reached.

Preferably, the latching projection has an internal upright projecting from a side face of the first runner and at least one branch extending from a tip of the upright remote from the side face and back towards the side face, the branch forming the flexible edge. The flexibility of the branch is increased when said branch has a free tip facing one of the side faces.

In order to avoid damage to the latching projection and/or parts of the support acting thereon, even with very powerful actuation of the telescopic pull-out shelf, the upright preferably forms a stop for the branch within the resilient deformability range thereof, so that by pressing the branch against the upright no plastic deformation of the branch may be produced.

On the resiliently flexible edge of the latching projection, an undercut is preferably formed which serves to anchor the support engaging in the undercut.

Preferably, the latching projection comprises two resiliently flexible edges opposing one another. When mounting the support on the latching projection, said edges may be pressed against one another, so that when the support is mounted, both edges press against the support and, as a result, resiliently displaceably hold said support without play, but to a limited extent.

Preferably, the latching projection is formed on an adapter mounted on the first runner. Such an adapter may be produced equally for right-hand and left-hand runners of a telescopic pull-out shelf or for pull-out shelf designs with runners of different lengths, whereby the manufacturing costs may be reduced.

Moreover, it is preferred that the first runner carries a second latching projection which comprises an undercut on a side facing the first latching projection and allows a storage device mounted on the first latching projection to engage with play in the undercut of the second latching projection in the direction of movement of the runners. Different coefficients of thermal expansion of the runners which generally consist of metal and the storage device which frequently consists of glass or plastics, may thus lead to high stresses between the latching projections and the storage device, associated with temperature fluctuations, which could result in tearing or premature material fatigue of one or the other.

In order to simplify the assembly of the storage device on the runner, a slot which is open towards the edge is preferably provided on the storage device, into which the second latching projection may be inserted by being displaced in the direction of movement.

A preferred field of use of the invention is that of telescopic pull-out shelves with runners movably guided relative to one another by linear ball bearings, as with said runners, due to the easy mobility of the runners relative to one another, the risk of powerful impacts is particularly high when a stop is reached.

Further features and advantages of the invention are revealed from the following description of embodiments by referring to the accompanying drawings, in which.

Figure 1:
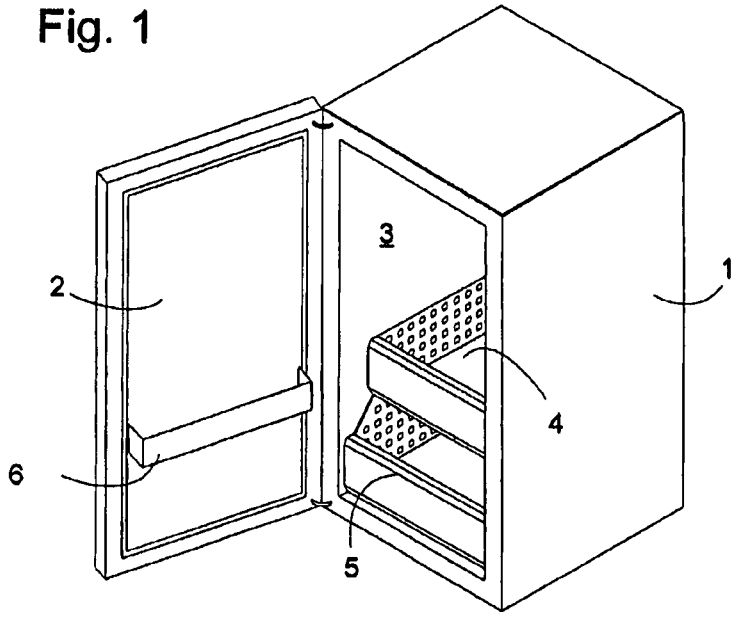
FIG. 1 shows a perspective view of a refrigeration device in which the present invention is implemented.

FIG. 1 shows a perspective view of a refrigeration device with a body 1 and a door 2. Two refrigerated goods carriers 4, 5 in the form of drawer compartments are shown by way of example in a cooling chamber 3 in the interior of the device. The drawer compartments 4, 5 are displaceably held on telescopic pull-out shelves, not visible in the figure, which are suspended on the side walls of the body 1. The upper drawer compartment 4 has a shallower depth than the lower drawer compartment 5, in order to allow space for a door storage device 6 fastened to the door 2.

Further refrigerated goods storage devices may be attached according to requirements, in the form of further drawer compartments or in the form of stationary or displaceable shelves, in the upper region of the cooling chamber 3 which is left empty in the figure.

Figure 2:
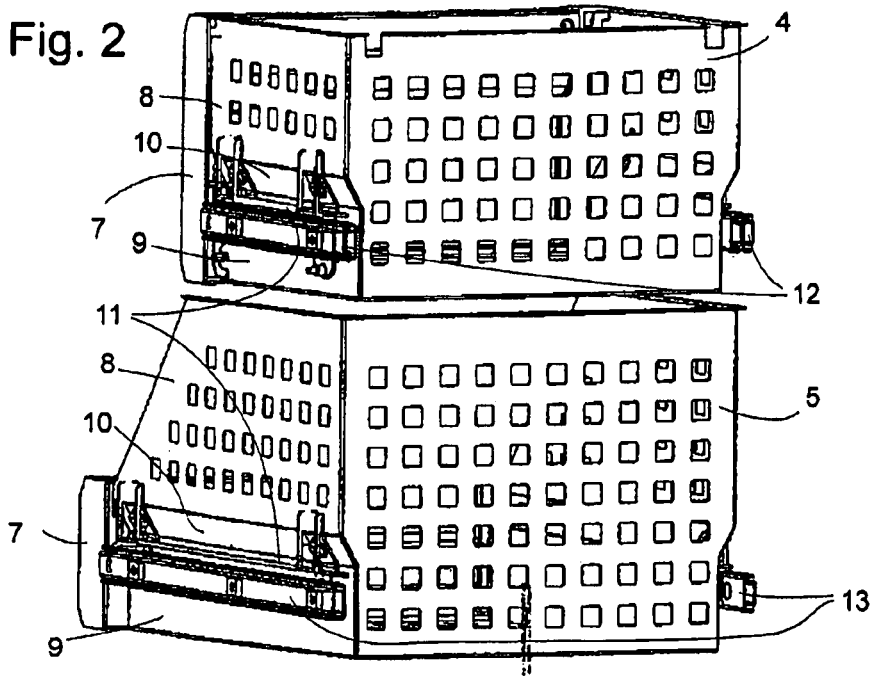
FIG. 2 shows a perspective view of two refrigerated goods carriers of the refrigeration device of FIG. 1.

FIG. 2 shows the two drawer compartments 4, 5 in a perspective view of their rear face. The drawer compartments 4, 5 respectively comprise a basket formed from perforated sheet steel, the front side of which facing the door being clad by a plastics shield 7. For the upper drawer compartment 4, this shield 7 extends over the entire height thereof, for the lower compartment 5 only over part of the height, so that between the shield 7 and the compartment 4 located thereabove, an engagement opening is formed, as may be seen in FIG. 1.

The side walls of the baskets have respective vertical upper and lower wall portions 8 and/or 9 and between said wall portions, oblique shoulders 10 which extend downwards towards one another. On the shoulders 10 respectively one support part 11 which is injection-moulded from plastics or formed from metal is fastened and which may be seen in more detail in FIGS. 4, 7 and 8. The support parts 11 are, in turn, supported via adapters on telescopic pull-out shelves 12 and/or 13, the adapters together with the support parts 11, establishing the premise that telescopic pull-out shelves of different widths, namely partial and complete pull-out shelves, may be mounted on refrigerated goods carriers of different designs.

The telescopic pull-out shelves 13 on which the lower drawer compartment 5 is supported, comprise one respective pair of runners engaging in one another. The freedom of movement of these runners relative to one another is between 50 and 80% of their length; in this case it is the same as the depth of the drawer compartment 4 located thereabove, so that the drawer compartment 5 in its position pulled out as far as the stop is completely pulled out under the compartment 4 located thereabove, and is freely accessible on its entire upper face.

Figure 3:
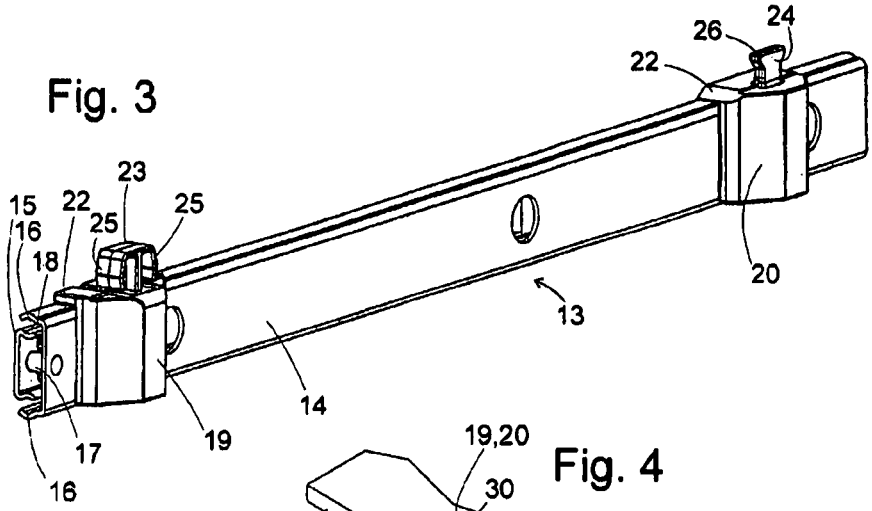
FIG. 3 shows a perspective view of a left-hand telescopic pull-out shelf of the lower refrigerated goods carrier.

FIG. 3 shows a perspective view of one of the telescopic pull-out shelves 13 of the lower drawer compartment 5 and namely of the left-hand pull-out shelf 13 from the perspective of an observer looking into the cooling chamber 3. The pull-out shelf comprises two curved runners made of sheet steel, an outer runner 14 of approximately C-shaped cross section and an inner runner 15 engaging in the hollow space of the outer runner 14. Branches of the runners 14, 15 opposing one another define two cylindrical channels 16 in which respectively a plurality of balls, not visible in the figure, are accommodated, which movably guide the runners 14, 15 with little clearance and in a simple manner relative to one another. A pin 17 projects from the front end of the outer runner 14 into the intermediate space between the runners 14, 15. Its contact with a rubber buffer 18, not visible in the figure, fastened to the inner runner 15, defines a limit to the freedom of movement of the runners 14, 15 relative to one another.

A front adapter 19 and a rear adapter 20 made of plastics are fastened to the outer runner 14. The adapters 19, 20 have, in this case, one respective base body 21 approximately in the shape of a truncated prism on which on its upper face a horizontal projection 22 bearing against the upper branch of the runner 14 is formed.

From the upper face of the base body 21 one respective latching element 23 and/or 24 projects, the structure and function thereof being explained below with reference to FIGS. 6 and 7.

Figure 4:
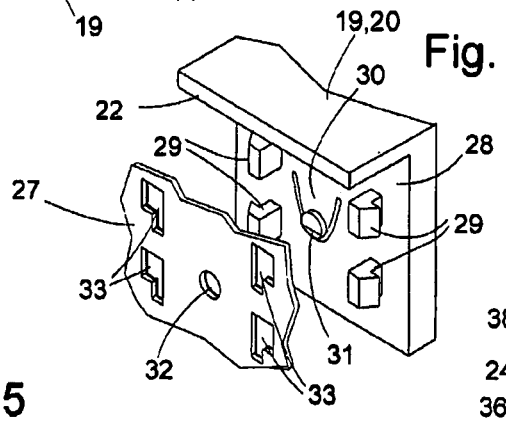
FIG. 4 shows respective fragments of a telescopic pull-out shelf runner and an adapter which illustrate the fastening of the adapter to the runner.

FIG. 4 is intended to illustrate the anchoring of the adapter 19, 20 to the runner 14. A fragment 27 of the runner 14 and one side of an adapter 19 or 20 facing said runner separated from one another, are respectively shown, the type of anchoring in both adapters 19, 20 being the same. The wall 28 of the adapter facing the fragment 27 carries 4 rigid latching hooks 29 and a resilient tongue 30 separately cut through a U-shaped or V-shaped slot from the wall 28, a wedge 31 projecting from the tip thereof. A round hole 32 and four square 33 holes of the runner 14 are located opposite said wedge, said runner being respectively in the form of a square which at its lower edge is lengthened by a short slot. In order to anchor the adapter 19 and 20 to the runner 14, the latching hooks 29 are inserted into the square holes 33 and at the same time, firstly the tongue 30, the wedge 31 thereof striking the closed wall of the runner 14, is forced back into the hollow base body of the adapter. When the latching hooks 29 are completely pushed through the holes 33, and the wall 28 of the adapter rests against the runner 14, the adapter may be pushed downwards so that the shafts of the latching hooks 29 engage in the slots of the holes 33 and the projection 22 comes to rest on the upper branch of the runner 14. At the same time the wedge 31 comes into contact with the round hole 32 and snaps therein. When this has occurred, the adapter may only be released from the runner 14 by the wedge 31 firstly being forced out of the hole 32 again by a tool and then the adapter being lifted.

Figure 5:
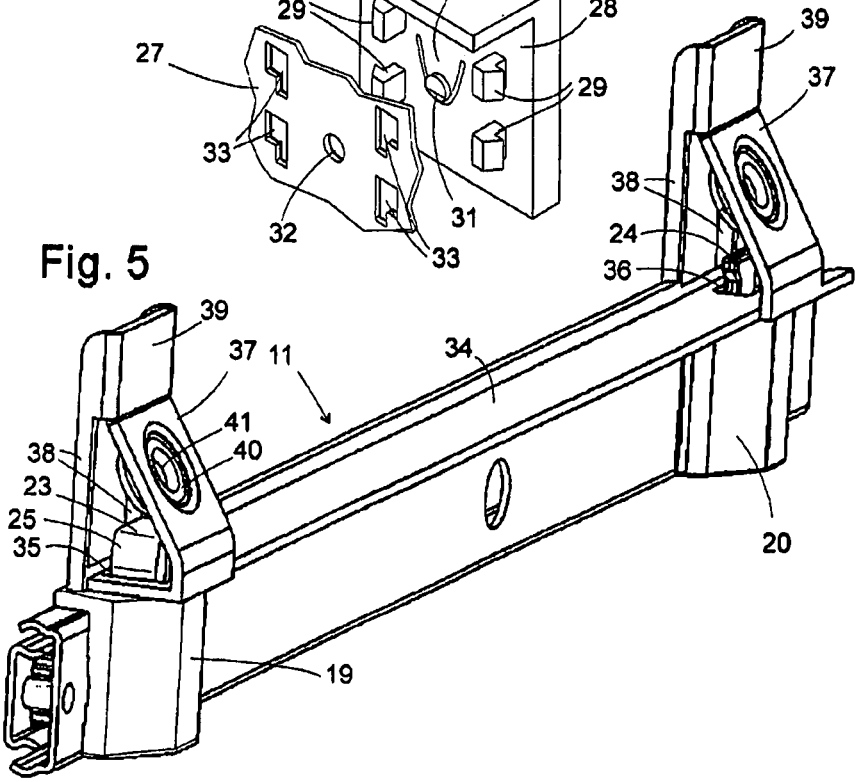
FIG. 5 shows the telescopic pull-out shelf of FIG. 3 with the support part mounted thereon.

FIG. 5 shows, in turn, a perspective view of the telescopic pull-out shelf 13 of FIG. 3, this time with the support part 11 engaged thereon. The support part 11 comprises an elongated base plate 34 which is supported on the upper sides of the adapters 19, 20. At one front end of the base plate 34, a receiver 35 configured as a square through-passage is formed, through which the latching element 23 of the adapter 19 is inserted. The pin 24 of the rear adapter 20 engages in a slot 36 of the base plate 34 open to the rear.

At both ends of the base plate 34, above the hole 35 and/or the slot 36, one respective abutment is formed for the basket of the pull-out shelf 5. The abutment respectively comprises an oblique plate 37 which at its lower edge is connected to an edge of the base plate 34 facing the basket, and which at its upper edge is combined with two vertical struts 38 extending from the base plate 34 to form a U-shaped profiled section 39. A planar recess 40 is in the centre of the plate 37 and in the centre thereof a bore 41 is, in turn, formed which are both widened towards the rear face of the plate 37 to a hexagonal cross section.

Figure 6:
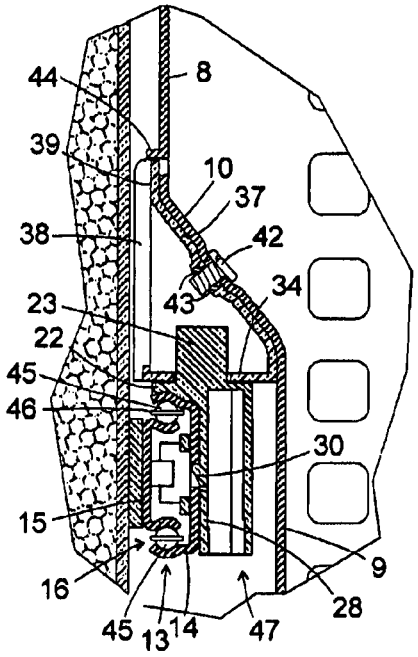
FIG. 6 shows a section through the telescopic pull-out shelf of FIGS. 3 and 5 and the surroundings thereof, at the level of an adapter.

FIG. 6 shows a section through the telescopic pull-out shelf and the surroundings thereof at the level of the adapter 19. As this section shows, the bore 41 of the plate 37 serves to fasten the shoulder 10 of the basket thereon by means of a screw 42 and a nut 43 positively received in the hexagonal widening of the bore. A tab 44 bent out from the upper portion 8 of the side wall of the basket is supported on the upper edge of the U-shaped profiled section 39.

The aforementioned balls 45 may also be seen in the section, which are attached in the channels 16 between the runners 14, 15, and a plurality of which are respectively guided in a cage 46.

Figure 7:
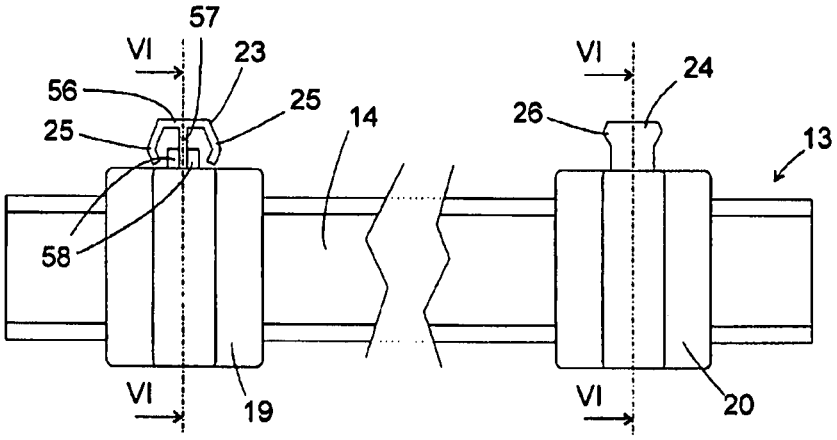
FIG. 7 shows a side view of the telescopic pull-out shelf of FIG. 3.

FIG. 7 shows a side view of the telescopic pull-out shelf 13 with adapters 19, 20 mounted on the outer runner 14 thereof. Cutting planes which provide the section shown in FIG. 6 are denoted in the figure by dotted lines VI-VI.

The latching element 23 of the front adapter 19 has in section approximately the shape of the letter T, at the ends of the cross beam 56 of the T two resilient branches 25 being formed, extending downwards and initially away from one another, then again towards one another. The lower portions of the branches 25 extending towards one another respectively form an undercut at the bottom of the latching element 23. From the upright 57 of the T to the right and to the left of the figure, two narrow projections 58 project which together with the upright 57 form a cross-shaped layout. The spacing between the projections 58 and the branches 25 is selected to be sufficiently small so that the branches 25 may be pressed by a force acting in the lateral direction against the projections 58, without the branches 25 being plastically deformed or being stressed in another manner causing material fatigue.

The latching element 24 of the rear adapter 20 is a rigid pin which at its upper end has a forwardly oriented lug 26.

Figure 8:
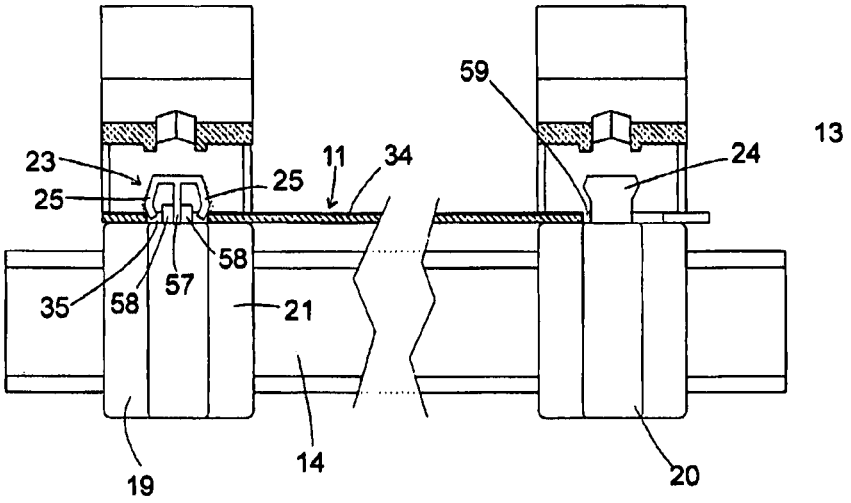
FIG. 8 shows a side view of the telescopic pull-out shelf of FIG. 3 with the support part shown in section mounted thereon.

FIG. 8 shows, in turn, the runner 14 with the adapters 19, 20 mounted thereon, in a side view, on this occasion, however, with the support part 11 fastened to the latching elements 23, 24 of the adapters 19, 20. The support part is shown in section in a plane extending through the latching elements 23, 24. The branches 25 of the latching element 23 are resiliently deformed, as may be seen by a comparison with the contour of the latching element 23 which is illustrated in dotted lines, in its relaxed configuration shown in FIG. 7, and their portions extending downwards towards one another, press against the front and rear edge of the hole 35 of the base plate 34 mounted on the latching element 23. Said base plate is, as a result, held without play on the latching element 23 in the undercut formed by said lower portions, in the direction of movement of the runner 14. Moreover, as the lower portions extending downwards towards one another of the resilient branches 25 press against the edges of the hole 35, the branches 25 also exert a downwardly oriented force on the base plate 34 which holds said base plate pressed against the base body 21 of the adapter 19 and thus also holds the support part 11 without play in the vertical direction.

When the runner strikes a path limiting stop and, as a result, the drawer compartment 4 is abruptly braked, the base plate 34 always exerts on one of the resilient branches 25 a force which advances said branch onto the upright 57 and/or one of the projections 58 projecting therefrom. The drawer compartment 5 may therefore slip to such an extent on the runner 14 in the direction of movement thereof, until contact with one of the projections 58 prevents further deformation of the resilient branch. The inertial forces which occur, when the runner 14 impacts against a stop and the drawer compartment 4 is abruptly braked, are thus markedly smaller than with a rigid connection between the drawer compartment and runner, so that a more light-weight, thin-walled and accordingly economical adapter 19 is sufficient to ensure a secure anchoring of the drawer compartment 4 on the telescopic pull-out shelf 13.

Between the front (to the left in the figure) side of the pin 24 of the rear adapter and the base plate 34 exists a clearance 59 which is at least as large as the spacing between the lower end of one of the branches 25 and the projection 58 facing said branch, so that when by inertial action, the retaining part 11 slips relative to the runner 14 to the rear (to the right in the figure), a hard impact between the pin 24 and the base plate 34 is eliminated.

In the section of FIG. 6, it may be seen that between the outer runner 14 and the lower wall portion 9 of the basket opposing said runner, an intermediate space 47 is located which is partially filled by the hollow base body 21 of the adapters 19 and 20. The width of this intermediate space 47 is greater than that of the telescopic pull-out shelf 13, so that it is possible if required, to accommodate a second telescopic pull-out shelf, without the dimensions of the drawer compartment 5 having to be modified.

In FIG. 2 it is seen that such an arrangement of two coupled telescopic pull-out shelves is provided on each side of the upper drawer compartment 4. Said coupled telescopic pull-out shelves provide the drawer compartment 4 with a freedom of movement which is greater than its depth, so that it may be pulled out completely to the front under a refrigerated goods carrier of the same depth, not shown, and arranged thereabove.

Figure 9:
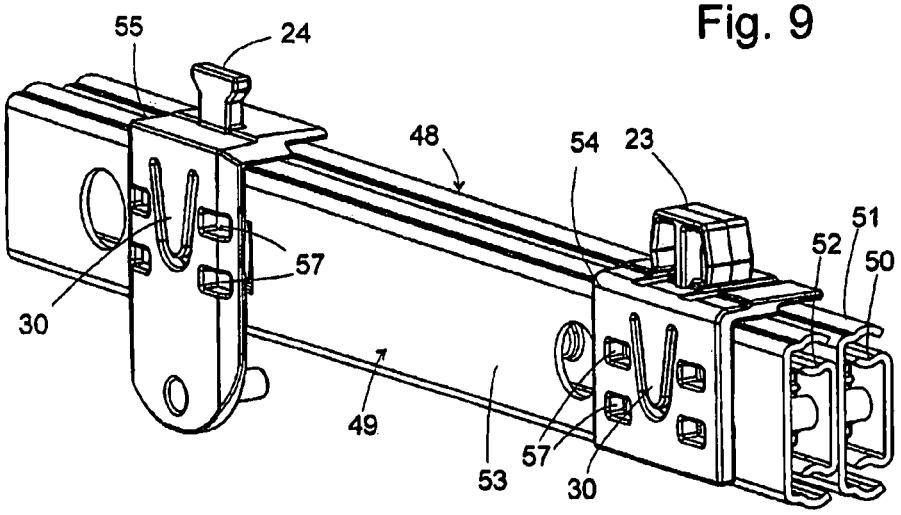
FIG. 9 shows a perspective view of a combined telescopic pull-out shelf for the upper refrigerated goods carrier of FIG. 2.

A perspective view of two telescopic pull-out shelves 48, 49 connected in series, on the right-hand side of the drawer compartment 4 and located from the perspective of the user standing in front of the cooling chamber 3, is shown in FIG. 9. The construction of the telescopic pull-out shelves 48, 49 with an inner runner 50 and/or 52 and an outer runner 51 and/or 53 which are movably guided relative to one another by means of balls 45, is the same as with the telescopic pull-out shelf 13 and thus does not need to be described again. The runners 51, 52 are connected rigidly to one another by rivets 58 shown in FIG. 10, of which one or other may simultaneously serve as a stop for limiting the freedom of movement of the pull-out shelves 48, 49.

Front and rear adapters 54 and/or 55 are clamped to the runner 53 in a similar manner as disclosed above with reference to FIG. 4. Instead of a wide hollow base body as with the adapters 19, 20, in this case only a narrow, plate-shaped base body is provided, on the visible side thereof the recesses 57 opposing the resilient tongue 30 and the latching hook 29 being able to be seen. The latching elements 23, 24 supported by the adapters 54, 55 are the same as for the adapters 19, 20. Thus on these adapters 54, 55 as may be seen in FIGS. 8, 9, the same type of support part 11 is also mounted as already described with reference to FIG. 5.

Figure 10:
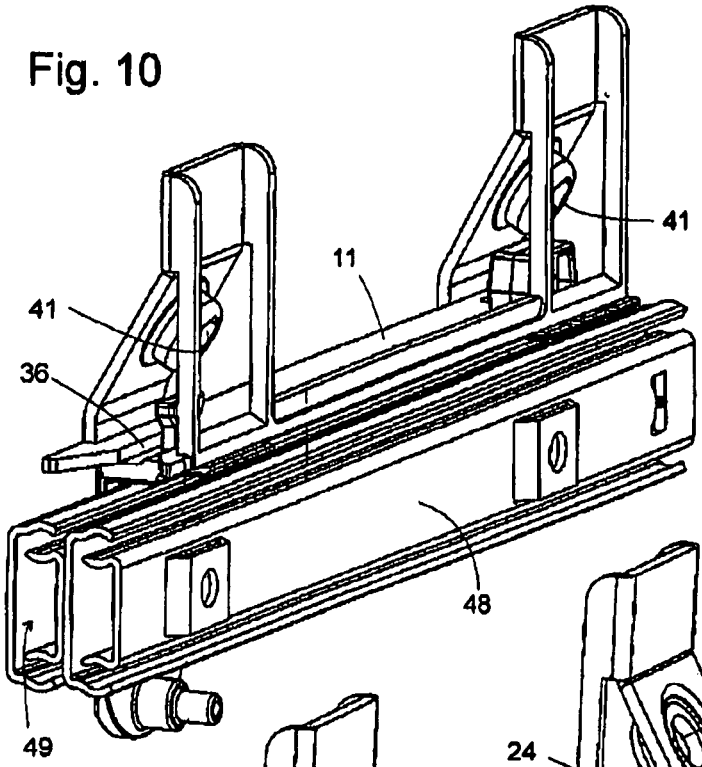
FIG. 10 shows the combined telescopic pull-out shelf of FIG. 9 with the support part mounted thereon, viewed from the side thereof facing the housing wall.
Figure 11:
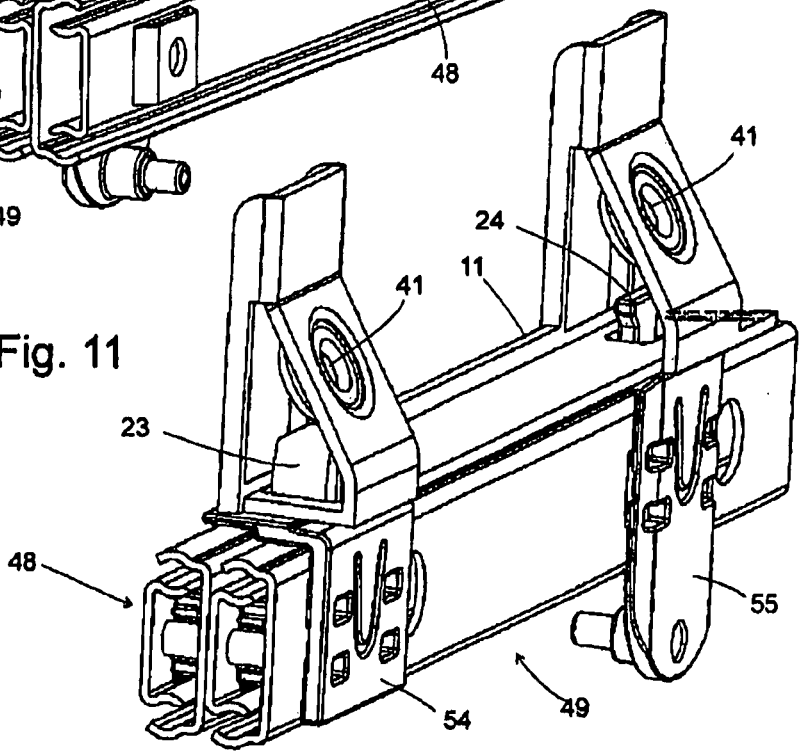
FIG. 11 shows a perspective view of the combined telescopic pull-out shelf and the support part, viewed from the cooling chamber of the refrigeration device.

In the view of FIG. 10 which shows the side of the telescopic pull-out shelves 48, 49 and the support part 11 facing the side wall of the body 1, the hexagonal widening of the bores 41 and the slot 36 in the base plate 34 of the support part 11 open to the rear towards the rear wall of the body 1, may be seen in particular. The slot has diverging edges towards the rear end of the base plate 34, in order to facilitate the positioning of the slot on the latching element 24 of the rear adapter.

Figure 12:
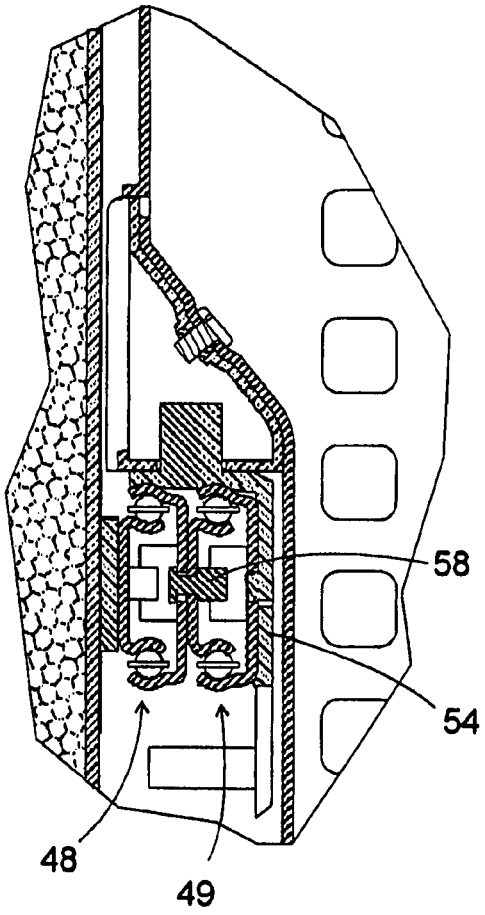
FIG. 12 shows a section similar to FIG. 6 through the combined telescopic pull-out shelf and the surroundings thereof, at the level of an adapter.

As may be seen in FIG. 12, by the additional telescopic pull-out shelf 49 and the plate-like base body of the adapters 54, 55 the intermediate space 47 is practically filled to the side of the wall portion 9 of the basket. The position of the latching projections 23 and 24 is, with reference to the side wall of the body and/or the pull-out shelf 48 mounted directly thereon, the same as shown in FIG. 6, so that identical support parts 11 and baskets in any configuration may be mounted on a simple pull-out shelf such as 13 or a double pull-out shelf such as 48, 49.

The invention claimed is:

1. A telescopic pull-out shelf comprising:

a first runner and a second runner, each runner having a longitudinal extent and the runners being operatively connected to one another such that the first runner and the second runner move relative to one another in a direction of longitudinal movement of the runners parallel to a longitudinal axis of the first runner and the second runner during a telescoping movement; and a support secured to the first runner, wherein the first runner supports a first latching projection having at least one edge, the at least one edge being resiliently flexible in the direction of longitudinal movement of the runners, the first latching projection engaged with a receiver on the support, and the receiver has a length in the direction of longitudinal movement of the runners sufficient to allow the first latching projection to move relative to the receiver in the direction of longitudinal movement of the runners such that there occurs a limited relative movement between the support and the first runner parallel to a longitudinal axis of the first runner and the second runner during the telescoping movement.

2. The telescopic pull-out shelf as claimed in claim 1, wherein the first latching projection includes an upright projection that projects from a side face of the first runner and at least one branch extending from a tip of the upright projection, the at least one branch being at a spacing from the side face of the first runner and the at least one branch forming the at least one.

3. The telescopic pull-out shelf as claimed in claim 2, wherein the at least one branch includes a free end proximal to the side face of the first runner.

4. The telescopic pull-out shelf as claimed in claim 2, wherein the upright projection forms a stop for the at least one branch, the stop operating to engage the at least one branch to stop a movement of the first latching projection relative to the receiver once a limited degree of deformation of the at least one branch has occurred and the stop being configured relative to the at least one branch such that the limited degree of deformation of the at least one branch is within range of resilient deformability of the at least one branch.

5. The telescopic pull-out shelf as claimed in claim 1, and further comprising an undercut formed on the at least one edge.

6. The telescopic pull-out shelf as claimed in claim 1, wherein the at least one edge includes two edges opposing one another.

7. The telescopic pull-out shelf as claimed in claim 1, wherein the first latching projection is formed on an adapter mounted on the first runner.

8. The telescopic pull-out shelf as claimed in claim 1, wherein the first runner carries a second latching projection, wherein a side of the second latching projection facing the first latching projection comprises an undercut.

9. The telescopic pull-out shelf as claimed in claim 8, wherein the support is engaged with the undercut to allow the first latching projection to move relative to the support in the direction of longitudinal movement of the runners.

10. The telescopic pull-out shelf as claimed in claim 8, wherein the second latching projection engages in a slot of the support and the slot is open in the direction of longitudinal movement.

11. The telescopic pull-out shelf as claimed in claim 8, wherein the first latching projection and the second latching projection are configured to retain a support part is connected to the support.

12. The telescopic pull-out shelf as claimed in claim 11, wherein the receiver is formed on the support part to receive at least one edge of the first latching projection.

13. The telescopic pull-out shelf as claimed in claim 12, wherein a slot is formed the support part at a distance from the receiver, the slot being open in the direction of longitudinal movement.

14. The telescopic pull-out shelf as claimed in claim 1, wherein the first runner and the second runner are movably guided relative to one another using linear ball bearings.

15. A refrigerator comprising:

a cooling compartment;

at least one refrigerated goods carrier movable between an extended disposition and a retracted disposition;

a first runner and a second runner to support the at least one refrigerated goods carrier for movement between the extended disposition and the retracted disposition, each of the first runner and the second runner having a longitudinal extent and the first runner and the second runner being operatively connected to one another such that the first runner and the second runner move relative to one another in their longitudinal direction of longitudinal movement of the runners parallel to a longitudinal axis of the first runner and the second runner during a telescoping movement; and a support secured to the first runner, wherein the first runner supports a first latching projection having at least one edge, the at least one edge being resiliently flexible in the direction of longitudinal movement of the runners, the first latching projection engaged with a receiver on the support, and the receiver has a length in the direction of longitudinal movement of the runners sufficient to allow the first latching projection to move relative to the receiver in the direction of longitudinal movement of the runners such that there occurs a limited relative movement between the support and the first runner parallel to a longitudinal axis of the first runner and the second runner during the telescoping movement.

16. The refrigerator as claimed in claim 15, wherein the first latching projection includes an upright projection that projects from a side face of the first runner and at least one branch extending from a tip of the upright projection, the at least one branch being at a spacing from the side face of the first runner and the at least one branch forming the at least one edge.

17. The refrigerator as claimed in claim 16, wherein the at least one branch includes a free end proximal to the side face of the first runner.

18. The refrigerator as claimed in claim 16, wherein the upright projection forms a stop for the at least one branch, the stop operating to engage the at least one branch to stop a movement of the first latching projection relative to the receiver once a limited degree of deformation of the at least one branch has occurred and the stop being configured relative to the at least one branch such that the limited degree of deformation of the at least one branch is within range of resilient deformability of the at least one branch.

19. The refrigerator as claimed in claim 15, and further comprising an undercut formed on the at least one edge.

20. The refrigerator as claimed in claim 15, wherein the at least one edge includes two edges opposing one another.

21. The refrigerator as claimed in claim 15, wherein the first latching projection is formed on an adapter mounted on the first runner.

22. The refrigerator as claimed in claim 15, wherein the first runner carries a second latching projection, wherein a side of the second latching projection facing the first latching projection comprises an undercut.

23. The refrigerator as claimed in claim 22, wherein the support is engaged with the undercut to allow the first latching projection to move relative to the support in the direction of longitudinal movement of the runners.

24. The refrigerator as claimed in claim 22, wherein the second latching projection engages in a slot of the support and the slot is open in the direction of longitudinal movement.

25. The refrigerator as claimed in claim 22, wherein the first latching projection and the second latching projection are configured to retain a support part is connected to the support.

26. The refrigerator as claimed in claim 25, wherein the receiver is formed on the support part to receive the at least one edge of the first latching projection.

27. The refrigerator as claimed in claim 26, wherein a slot is formed the support part at a distance from the receiver, the slot being open in the direction of longitudinal movement.

28. The refrigerator as claimed in claim 15, wherein the first runner and the second runner are movably guided relative to one another using linear ball bearings.

* * * * *